United States Patent [19]

Claffey

[11] Patent Number: 4,939,877

[45] Date of Patent: Jul. 10, 1990

[54] ANCHOR DEVICE

[76] Inventor: Paul J. Claffey, 1013 Calloway, Hurst, Tex. 76053

[21] Appl. No.: 292,523

[22] Filed: Dec. 30, 1988

Related U.S. Application Data

[63] Continuation-in-part of Ser. No. 140,590, Jan. 4, 1988, abandoned.

[51] Int. Cl.[5] ..... E02D 5/74

[52] U.S. Cl. ..... 52/155; 52/156; 52/163; 248/156

[58] Field of Search ..... 52/165, 155, 156, 158, 52/159, 153, 154, 103; 40/606, 607; 248/156; 404/9

[56] References Cited

U.S. PATENT DOCUMENTS

| | | | |
|---|---|---|---|
| 1,214,679 | 2/1917 | Hindmarsh | 52/156 |
| 2,580,948 | 1/1952 | Pancake . | |
| 3,213,824 | 10/1965 | Jenkins | 52/155 X |
| 3,307,305 | 3/1967 | Atkinson | 52/155 X |
| 3,342,444 | 9/1967 | Nelson | 52/165 |
| 4,120,125 | 10/1978 | Cvetan | 52/156 |
| 4,249,715 | 2/1981 | Repp . | |
| 4,254,597 | 3/1981 | Feldman et al. | 52/103 |
| 4,279,104 | 7/1981 | Classen | 52/165 X |
| 4,326,352 | 4/1982 | Barth | 248/156 X |
| 4,407,505 | 10/1983 | Kendziorski . | |
| 4,459,787 | 7/1984 | Wilcox | 52/155 |
| 4,483,506 | 11/1984 | Litwiller | 248/156 X |
| 4,753,411 | 6/1988 | Lechner et al. | 248/156 X |

*Primary Examiner*—Richard E. Chilcot, Jr.

*Attorney, Agent, or Firm*—John F. Booth; Gerald G. Crutsinger; Norman L. Gundel

[57] ABSTRACT

A removable earth anchor for supporting the post of signs, flags, road markers and the like. The anchor is designed to accommodate connection to various types and shapes of support posts.

1 Claim, 3 Drawing Sheets

ANCHOR DEVICE

RELATED UNITED STATES APPLICATION

This is a continuation in part of copending application Ser. No. 140,590 filed Jan. 4, 1988, now abandoned entitled Anchoring Device, Inventor: Paul J. Claffey.

BACKGROUND OF THE INVENTION

The present invention relates to devices used to anchor signs, flags, road marks and the like. Small portable signs for example are used in many applications. The most common form of these signs is what is commonly known as a "yard sign" consisting of an elongated post for inserting into the ground. The post carries a sign, flag or the like. One type of sign in common use consists of a metal sign attached to an elongated angle iron post. Other signs have posts of different shapes such as round or square tubing. The post is typically pointed on the end away from the sign so that it can be driven into the ground to anchor the sign in place. On some signs, a cross member is welded to the angle iron to allow the sign to be pushed into the ground by use of the heel of the shoe. This type of sign is used as a real estate yard sign to announce that the property is for sale or for rent.

Although signs of this type have proven to be suitable for their purpose, difficulty in installing the signs is encountered when the signs are installed in a rocky or tight clay soil. This presents a problem for the real estate agent who is required to drive the sign into the ground typical by about eight (8) inches to securely anchor the sign in place. As a result, extreme forces must be applied to the sign during installation in all but the most ideal of soils. Hammering on the upper end of this heavy unwielding sign is difficult and can damage the sign. Driving the sign into the ground by use of one's foot is dangerous and difficult. A sign post with a point dulled or bent during installation must be discarded. Signs are expensive and if they are damaged during installation, the entire sign must be discarded.

SUMMARY OF THE INVENTION

The present invention relates to improved anchors. According to the preferred embodiment of the present invention, an anchor assembly is attached for illustrative purpose to the end of a sign post. The anchor assembly has means removably attaching the anchor assembly to the sign post so that the anchor assembly may be separately handled. The anchor assembly has means for penetrating the earth and a surface means or alternatively a sign post connecting tube for removably supporting a sign in place. In use, the anchor assembly is first placed on the surface of the ground in the appropriate location. The anchor is driven into the ground. The sign is connected directly to the anchor or by means of a connecting tube.

In this manner, the anchor means can be easily driven into the ground because of its small compact size, thus avoiding the unwieldy attempt to control the sign while driving it into the ground. In addition, the anchor means can be removed and discarded if it becomes damaged during use or installation, allowing the sign portion to be used over and over.

The anchor has a star shaped sleeve which can be readily connected to posts of various shapes. The connecting tube is shaped to assist in connecting the anchor sleeve to various types of posts.

BRIEF DESCRIPTION OF THE DRAWINGS

The present invention will be more easily understood from the following detailed description of the preferred embodiment when taken in conjunction with the attached drawings in which.

Figure 1:
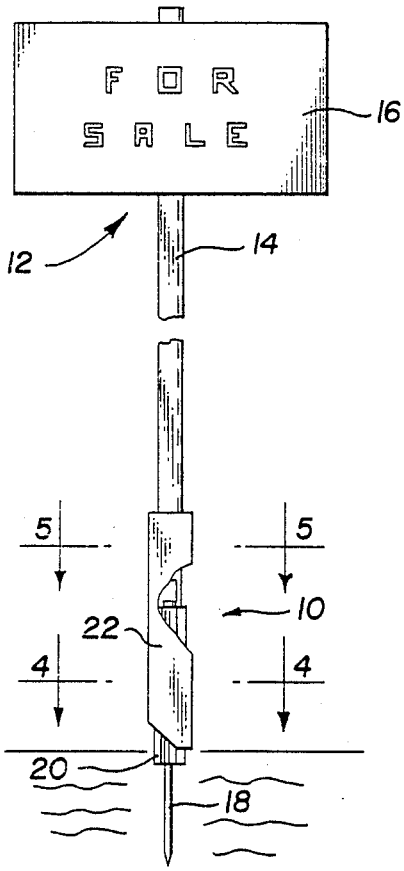
FIG. 1 is an elevation view of the improved earth anchor of the present invention shown installed in the ground and for illustrative purposes supporting a real estate sign.
Figure 4:
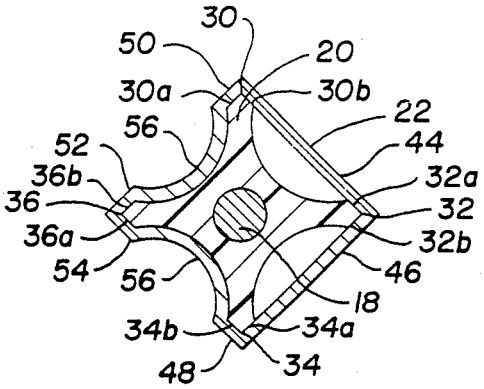
FIG. 4 is a sectional view thereof taken on line 4—4 of FIG. 1, looking in the direction of the arrows.
Figure 5:
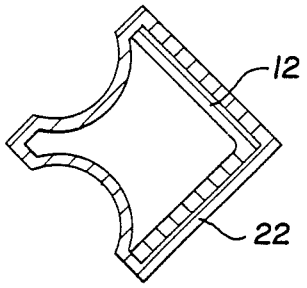

FIGS. **4*a* and 4*b* are sectional views similar to FIG. 4** showing alternative configurations;

FIG. 5 is a sectional view thereof taken on line 5—5 of FIG. 1, looking in the direction of the arrows; and FIGS. **5*a* and 5*b* are sectional views similar to FIG. 5** showing alternative configurations.

DESCRIPTION OF THE PREFERRED EMBODIMENT

Referring now to the drawings wherein like reference characters designate like or corresponding parts throughout the several views, there is shown in the figures the improved anchor 10 of the present invention shown supporting a real estate sign assembly 12. The sign assembly 12 consists of a sign post 14 attached to a rectangular sign 16 by suitable fasteners (not shown). The particular sign configuration illustrated is typical in use in the real estate industry wherein the sign post 14 is constructed from angle iron material.

The anchor assembly 10 of the present invention is illustrated installed in the ground and supporting the sign assembly 12. As will be described in detail, the anchor assembly 10 is removably attached to the sign post 14 in such a manner that the anchor assembly can be driven into the ground and the sign post 14 removably attached to the anchor assembly after the installation is complete.

The anchor assembly 10 is substantially smaller and lighter than the sign assembly 12, which facilitates installation and transportation of the anchor assembly. In addition, the anchor assembly is removably attached to the sign and when the anchor assembly becomes worn out, it can be discarded separate from the sign and the sign post.

In addition, as will be pointed out herein, the anchor assembly of the present invention is designed to accommodate various sizes and shapes of sign posts 14 and that the assembly can accommodate not only post constructed from angle iron but also posts from circular or square tubing.

The anchor assembly 10 comprises three basic elements, i.e., a ground spike 18, a sleeve 20 and a connector tube 22. The spike 18 has a circular cross section elongated shaft with a pointed end 24 and a head 26 on the opposite end thereof. Preferably, the spike 18 is constructed from durable material such as steel to withstand the pounding of being driven into the ground.

Figure 3:
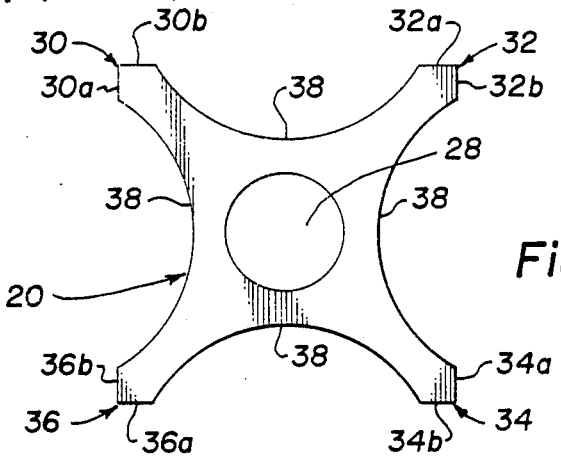
FIG. 3 is a plan view of the sleeve of the present invention.

Sleeve 20 is shown in detail in FIG. 3 and has a bore 28 extending through the length thereof of a size and shape to receive the spike 18 therein. If desired, the bore 28 can be sized such that a pressor interference fit occurs between the shaft of the spike 18 and the bore to prevent relative movement of the sleeve 20 of the spike 18.

Figure 2:
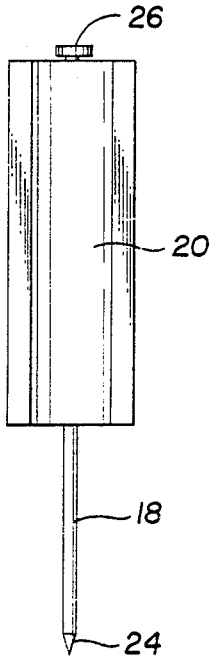
FIG. 2 is an elevation view of the sleeve and spike of the present invention.

As can be seen in FIG. 2, the sleeve 20 has an elongated shape and the spike when properly installed in the sleeve has the head 26 resting against the upper end of the sleeve 20. The four pointed star shaped cross section of the sleeve 20 is shown in FIG. 3. The four points of the cross section are generally designed in a clockwise direction by reference numerals 30, 32, 34 and 36. The apex of the point 30 illustrates a line formed by the intersection of the surfaces 30*a* and 30*b*; likewise, point 32, 34 and 36 are formed by intersections between surfaces with corresponding numbers and sub-designations. In the illustrated embodiment, the surface 30*a* and 30*b* are typical of the corresponding surfaces on the other three points of the star cross section and are set at right angles to each other. In addition, the surface 30*a* extends parallel to and coplanar with surface 36*b* while the surface 30*b* extends parallel and coplanar with the surface 32*a*. This pattern is repeated with surfaces 36*a* and 34*b* being parallel and coplanar and surface 34*a* and 32*b* being likewise parallel and coplanar.

Figure 4A:
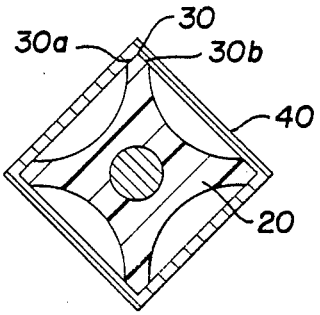
Figure 4B:
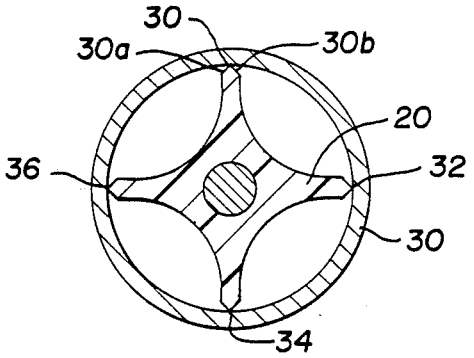

Concave portions 38 are formed between each of the points and extend the longitudinal length of the sleeve 20. The versatility of the shape of the sleeve 20 is illustrated in FIGS. 4, 4*b* and 4*c*. In FIG. 4, which will be described in detail hereinafter, the sleeve 20 is shown with the unique connector tube 22. In FIG. 4*a*, sleeve 20 is shown inserted into a length of square tubing 40. As is shown in FIG. 4*a*, the point 30 defined by the typical surfaces 30*a* and 30*b* is in close proximity with the interior corner of the square tubing and the surfaces 30*a* and 30*b* provide support by being coincident with the interior walls of the square tubing 40 as shown.

In FIG. 4*b*, sleeve 30 is shown inserted into a length of circular tubing 42 with points 30, 32, 34 and 36 engaging the interior walls of the tubing 42 to provide support.

Figure 5A:
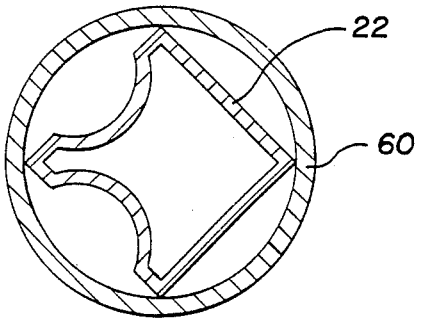
Figure 5B:
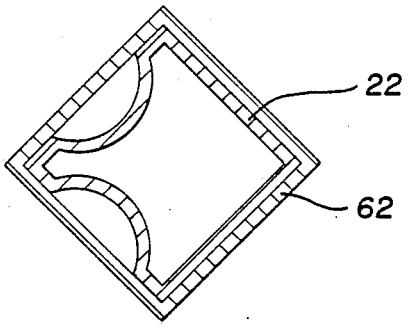

According to a particular feature of the present invention, sleeve 20 is particularly adapted to fit in the unique shaped connection tube 22 (see FIG. 4). Tube 22 has two adjacent planer sides 44 and 46 positioned at right angles to each other. The inside wall of sides 44 and 46 contact the surfaces 30*b*, 32*a*, 32*b* and 34*a*. Tube 22 also has sides 48 and 50 thereon. Side 48 extends perpendicular to the side 46 while the side 50 extends perpendicular to the side 44. The inside wall of side 40 contacts the surface 34*b* while the inside wall of side 50 contacts the surface 30*a*. In addition, sides 52 and 54 intersect each other at right angles. Sides 50 and 52 are parallel and coplanar while sides 54 and 40 are likewise parallel and coplanar. A concave portion 56 is positioned between sides 50 and 52. The concave portion 56 conforms to concave portion 38. Likewise, a similar concave portion 56 separates sides 40 and 54. The cross section of the sleeve 20 would be square except for the two indentions 56. A particular advantage of the connection tube 22 is its ability to snugly connect to the sleeve 20 while firmly receiving an angle iron shaped shaft 12 therein as shown in FIG. 5. In addition, a circular tubing 60 can be connected to the tube 22 as shown in FIG. 5*a* and square tubing 62 can be connected to the tube 22 as shown in FIG. 5*b*.

To install the anchor assembly in the ground, an assembly of the spike 18 and sleeve 20 are positioned at the point where the sign is to be installed. The upper end of the assembly can be stuck to drive the shaft into the soil and anchor it in place. The sign post is then connected to the sleeve either by use of the connection tube 22, as shown in FIGS. 5, 5*a* and 5*b* or by directly connecting the sign post as shown in FIGS. 4*a* and 4*b*. Alternatively, the anchor and connecting tube assembly could be used to support marker poles, temporary fence posts or the like.

It is to be understood, of course, that the foregoing description of the preferred embodiments of the present invention is not to be construed as limited to these particular described embodiments, since these are to be regarded as illustrative rather than restrictive. The invention is intended to cover all configurations covered by the spirit and scope of the appended claims.

What is claimed is:

1. A ground anchor assembly for removably supporting the post of a sign, flag, road marker or the like in the ground comprising:

a sleeve, a connector tube and a spike means, said sleeve having an elongated shape and a central bore extending therethrough lengthwise, said sleeve having a four-pointed star cross section configuration, said connector tube being of a generally quadrilateral shape with two planer faces and two faces with concave portions formed therein, and surface means on said connector tube for selective connecting to an angle, circular or square shaped post, the exterior surface of said sleeve being formed to receive said connector tube thereby removably connecting said post to said anchor assembly, said spike means comprising an elongated shaft with an enlarged head formed at one end thereof and a point formed on the end opposite said one end, said spike being mounted in said sleeve and being of sufficient length to extend through said sleeve with the head of said spike abutting the end of said sleeve whereby said pointed end of said spike can be inserted into the ground to anchor said assembly in place.

* * * * *

UNITED STATES PATENT AND TRADEMARK OFFICE

CERTIFICATE OF CORRECTION

PATENT NO. : 4,939,877

DATED : July 10, 1990

INVENTOR(S) : Paul J. Claffey

It is certified that error appears in the above-identified patent and that said Letters Patent is hereby corrected as shown below:

ON THE TITLE PAGE

Please correct the Abstract to read as follows:

-- ABSTRACT

A sign post anchor assembly comprising a sleeve, a spike and a connector tube, said sleeve having a lengthwise bore for passage of the spike shaft therethrough to anchor said sleeve to the ground and said sleeve also having an outer surface configuration to receive and hold said connector tube therearound, said connector tube having a generally quadrilateral shape with two planar faces and two concave surfaces and adapted for selectably and removably connecting an angle, circular or square shaped sign post to said assembly. --

Signed and Sealed this

Seventeenth Day of September, 1991

*Attest:*

HARRY F. MANBECK, JR.

*Attesting Officer*

*Commissioner of Patents and Trademarks*